US005271233A

United States Patent [19]

Parker et al.

[11] Patent Number: 5,271,233

[45] Date of Patent: Dec. 21, 1993

[54] METHOD AND MEANS FOR PROVIDING REFRIGERATION

[75] Inventors: Giles W. Parker; Daniel M. Verster, both of Transvaal, South Africa

[73] Assignee: African Oxygen Limited, Selby, South Africa

[21] Appl. No.: 905,091

[22] Filed: Jun. 26, 1992

[30] Foreign Application Priority Data

Jun. 28, 1991 [ZA] South Africa ..... 91/5027

[51] Int. Cl.[5] ..... F25D 3/12

[52] U.S. Cl. ..... 62/62; 62/239; 62/384; 62/388; 62/418; 62/529

[58] Field of Search ..... 62/62, 239, 245, 384, 62/387, 388, 529, 530, 418, 407

[56] References Cited

U.S. PATENT DOCUMENTS

| | | | |
|---|---|---|---|
| 3,561,226 | 2/1971 | Rubin | 62/388 X |
| 3,792,595 | 2/1974 | Willis | 62/239 X |
| 3,864,936 | 2/1975 | Frank et al. | 62/384 X |
| 4,050,365 | 9/1977 | Freeman, Jr. | 62/407 |
| 4,206,616 | 6/1980 | Frank et al. | 62/384 X |
| 4,502,293 | 3/1985 | Franklin, Jr. | 62/388 |
| 4,593,536 | 6/1986 | Fink et al. | 62/239 |
| 4,741,167 | 5/1988 | Wigley | 62/388 X |
| 4,761,969 | 8/1988 | Moe | 62/388 |
| 4,766,732 | 8/1988 | Rubin | 62/62 |
| 4,891,954 | 1/1990 | Thomsen | 62/239 |
| 4,951,479 | 8/1990 | Araquistain et al. | 62/239 |
| 5,152,155 | 10/1992 | Shea et al. | 62/388 X |

FOREIGN PATENT DOCUMENTS

| | | | |
|---|---|---|---|
| 100927 | 5/1937 | Australia | 62/384 |
| 1094335 | 1/1981 | Canada | 62/384 |
| 434569 | 9/1935 | United Kingdom | 62/388 |

*Primary Examiner*—Henry Bennet
*Assistant Examiner*—Christopher Kilner
*Attorney, Agent, or Firm*—David M. Rosenblum; Larry R. Cassett

[57] ABSTRACT

A method and apparatus in which a container is provided with a refrigeration facility. A holder for holding carbon dioxide snow is placed within the interior of the container so that the carbon dioxide snow is in gaseous communication with the interior of the container. The holder or a continuous wall region of the holder, constituting about 15% of the total wall area of the holder, is fabricated of a flexible material that is at least substantially impermeable to the carbon dioxide snow and permeable to gaseous carbon dioxide. Additionally, a combination container and holder is disclosed along with a combination holder and support structure. The support structure is attachable to the container to support the holder so that the carbon dioxide snow is in gaseous communication with the interior of the container.

12 Claims, 9 Drawing Sheets

METHOD AND MEANS FOR PROVIDING REFRIGERATION

BACKGROUND OF THE INVENTION

This invention relates to a method and means for providing in-transit refrigeration for goods.

The use of carbon dioxide snow for in-transit refrigeration is known. Conventionally, carbon dioxide snow is introduced directly into a transport container through a port in a wall or door of the container. The carbon dioxide snow settles onto the goods being transported and onto the container walls, and can thereby cause severe thermal shock to the goods and to the walls of the container. Furthermore, a significant proportion of the carbon dioxide snow particles sublimes when coming into contact with relatively warm container walls and goods, and most of the cold gaseous carbon dioxide formed by sublimation is immediately swept out of the container with the main snow shooting gas stream. The cooling potential of this gas is thereby lost.

Applicants are also aware of containers having permanent solid wall bunkers of "plenums" as they are called. Carbon dioxide snow is injected into the permanent bunker which is usually located in the upper region of the container near the ceiling. The thermal shock problems of the above mentioned conventional method as far as the goods are concerned, are reduced thereby and a longer lasting cooling effect results. However, disadvantages of this method include thermal shock to the bunker (i.e. plenum) walls and further include relatively high installation costs and a reduced payload in the container to compensate for the extra weight of the permanent bunker wall and resulting reduced loading space. Furthermore, the plenum has a relatively high thermal absorption capacity, similar to that of the container walls, and also insulates the carbon dioxide snow it contains from heat which leaks into the container (hereinafter referred to as "heat in-leak"). Thus there is a significant delay before the heat in-leak is compensated for by sublimation of some of the carbon dioxide snow in the plenum, thereby reducing the efficiency of this system for maintaining goods at a low and constant temperature.

SUMMARY OF THE INVENTION

According to the invention there is provided a method of providing a container for goods with a refrigeration facility. The method includes placing in gaseous communication with the interior of the container, a holder for holding carbon dioxide snow. The holder has a total wall area and one of the holder or a continuous wall region of the holder, constituting at least about 15% of the total wall area of the holder, is fabricated of a flexible material that is at least substantially impermeable to the carbon dioxide snow and permeable to gaseous carbon dioxide.

The term "refrigeration" as used herein and in the claims means lowering of the temperature of goods and/or maintaining goods at a relatively low temperature and/or reducing the rate of increase in the temperature of goods.

Carbon dioxide "snow" as used herein and in the claims means carbon dioxide in a powder form, and which is conventionally made by means of an appropriate device, typically a lance provided with a nozzle, through which liquid carbon dioxide at an appropriate temperature and pressure is forced. This process is commonly known as "SNOW SHOOTING" which is a trade mark of The BOC Group.

Preferably the continuous wall region which is of a flexible material constitutes at least 25% of the total wall area of the holder, more preferably 60 to 100%, and ideally 100% thereof.

By "total wall area" is meant herein and in the claims the total area of the outside surface of the holder wall(s).

The method may include locating the holder in the container so that it is readily removable from the container, and may further include providing a support structure for the holder within the container and locating the holder in the container by attaching it to the support structure. Where the container has a ceiling, the method may include locating the holder at or adjacent the ceiling of the container so that it is situated above the goods in use.

Where the holder is readily locatable in a container and, further, readily removable from the container at will, then the method of the invention may include introducing the carbon dioxide snow into the holder before it is located in the container.

Instead, the holder can be charged with carbon dioxide snow after it has been appropriately located in the container.

According to a further aspect of the invention, there is provided a holder including holding means for holding carbon dioxide snow in gaseous communication with the interior of the container for goods. The holding means has a total wall area and one of the holding means and a continuous wall region of the holding means, constituting at least about 15% of the total wall area of the holding means, is fabricated of a flexible material that is at least substantially impermeable to the carbon dioxide snow and permeable to gaseous carbon dioxide.

The holder preferably has an insignificant thermal absorption capacity. By this is meant herein and in the claims that the thermal absorption capacity of the holder is low relative to that of the container walls and related equipment and relative to the goods intended to be refrigerated in the container, so that any heat in-leak is experienced by the carbon dioxide snow with minimal delay to cause substantially immediate sublimation of carbon dioxide snow to compensate for the heat in-leak.

The holder may be of a fabric of cotton, wool or plastics material, or may be of wire mesh. For example, the fabric may be a woven polypropylene, polyethylene or nylon cloth.

A preferred holder according to the invention comprises a bag of a gas permeable material which acts as a phase separator by allowing the gaseous carbon dioxide to pass through it while retaining the carbon dioxide snow which while the holder is being charged with carbon dioxide snow, e.g. by snow shooting, is forced outwardly towards the wall(s) of the bag by the escaping gaseous carbon dioxide. Semi-compaction of the solid carbon dioxide snow phase results.

The holder may have attaching means whereby it can be attached to the support structure within the container. The attaching means may be removably attachable to the support structure to enable the holder readily to be removed from the container.

The applicant envisages that the method and holder of the invention will be particularly useful for in-transit refrigeration. Such applications will involve, inter alia, maintenance of the relatively low temperatures of a variety of frozen or chilled goods, particularly beverages and foodstuffs such as meat, seafood, confectionery, poultry, vegetables, fruit, yeast and dairy products while they are in bar/drinks trolleys, hand held containers, etc. or while they are being transported in road vehicles, railcars, shipping or aircraft containers or the like.

The amount of carbon dioxide snow and hence the size of the holder required for a particular application will be influenced by a variety of parameters which include the size of the container, its specific heat and insulative properties (i.e. the material of which the container is made and the nature and thickness of any additional insulation), the nature and mass of any goods being transported in the container, ambient temperature, the respective initial and desired temperatures within the container, the respective initial and desired temperatures of the goods, the expected duration of transportation to destination, the expected number of times the container is expected to be opened before it reaches its destination, etc.

The invention extends to a container for goods which comprises a holder according to the invention or which has been provided with a refrigeration facility according to the method of the invention.

The invention extends further to a support structure/holder combination for use in a method of providing a container for goods with a refrigeration facility, which combination comprises a holder for holding carbon dioxide snow, which holder or a continuous wall region thereof constituting at least about 15% of the total wall area of the holder, is of a flexible material that is at least substantially impermeable to the carbon dioxide snow and permeable to gaseous carbon dioxide; and a support structure for supporting the holder and which is attachable to the container in a position in which, in use, the carbon dioxide snow in the holder is in gaseous communication with the interior of the container.

BRIEF DESCRIPTION OF THE DRAWINGS

The invention is now described by way of the following non-limiting examples and with reference to the accompanying drawings in which.

DETAILED DESCRIPTION

Figure 1:
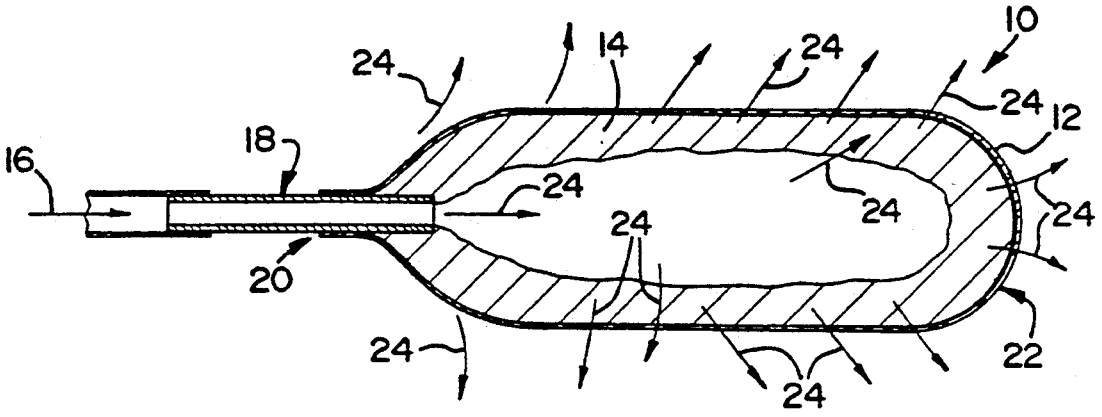
FIG. 1 is a schematic diagram of a first embodiment of a holder according to the invention in the form of a bag, which is being charged with carbon dioxide snow.
Figure 2:
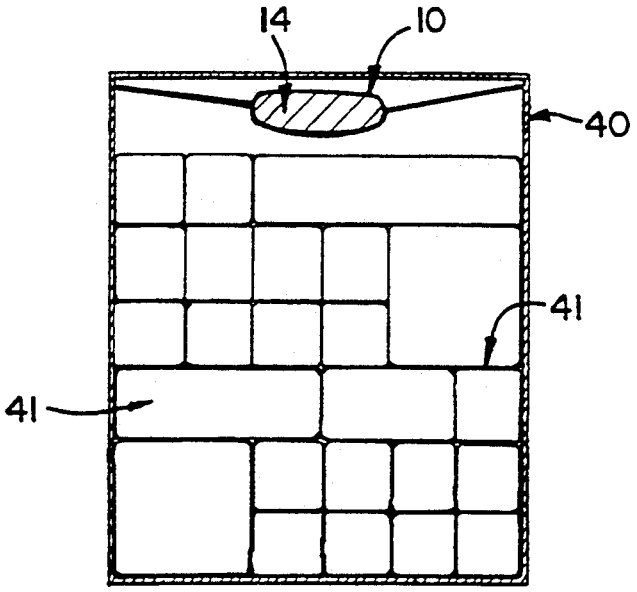
FIG. 2 is a schematic section through a container which has been provided with a refrigeration facility according to the method of the invention.

In FIGS. 1 and 2, reference numeral 10 generally indicates a holder according to the invention in the form of a bag for carbon dioxide snow.

The bag 10 is of a nylon, polyethylene or polypropylene material 12 which is tightly woven so that the apertures are in the order of 0.5 mm in size. This material 12 is substantially impermeable to carbon dioxide snow but is permeable to gaseous carbon dioxide.

When expanded to its greatest extent, the size of the bag 10 is approximately 2.0 m×2.0 m×0.25 m and holds 400 kg of carbon dioxide snow.

In order to charge the bag 10 with carbon dioxide snow 14 according to the method of the invention, liquid carbon dioxide (indicated by arrow 16) at approximately −20° C. and 20 bar pressure is forced, via a conventional snow shooting lance 18, through an inlet port 20 into the bag 10. Carbon dioxide snow 14 is driven against the inside wall 22 of the bag 10 by gaseous carbon dioxide (indicated by arrows 24) escaping through the permeable wall 22. As the snow shooting process continues, carbon dioxide snow 14 is semi-compacted along the inside wall of the bag 10.

By weighing the bag 10 after it had been charged with carbon dioxide snow 14 and measuring the mass of liquid carbon dioxide 16 used to charge the bag 10, a conversion rate of liquid carbon dioxide to carbon dioxide snow can be determined. By using the method of this example, a conversion rate approximating to 2:1 is obtainable. It will be appreciated that this is significantly better than conventional conversion rates of approximately 2.5 to 3:1. Indeed, according to the method of the invention, a conversion rate approximating to the theoretical value is obtainable.

Figure 4:
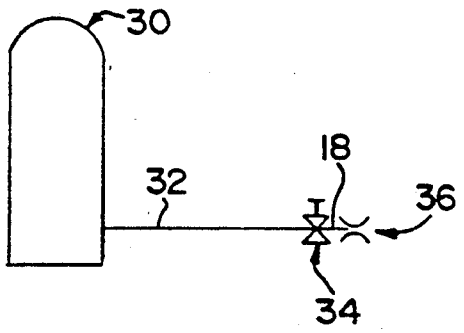
FIG. 4 is a schematic diagram of a typical carbon dioxide snow making device.

A conventional snow making device can be used to charge the bag 10 with carbon dioxide snow 14. Such a device is shown schematically in FIG. 4 in which reference numeral 30 indicates an insulated vessel containing liquid carbon dioxide at typically minus 20° C. and 20 bar pressure, reference numeral 32 indicates a liquid carbon dioxide supply line comprising a 25 mm diameter copper tube or flexible stainless steel hose, numeral 34 indicates an isolation valve (typically a 25 mm diameter ball valve), and reference numerals 18 and 36 indicate a snow shooting lance and a 6.35 mm diameter Venturi nozzle which is capable of delivering 20 kg carbon dioxide snow per minute.

In use, the bag 10, charged with carbon dioxide snow 14, is suspended from the walls or ceiling of a container 40 and adjacent the ceiling thereof, in the manner shown in FIG. 2. The container 40 is a standard international container having dimensions 2.4 m×2.4 m×6.0 m and having 75 mm polyurethane insulated walls. The container 40 has a 100 mm diameter inlet port (not shown in FIG. 2) for carbon dioxide snow and a gas vent (not shown in FIG. 2) which is 150 mm square. The container 40 is loaded, on average, with 10 to 18 ton weight of frozen foodstuff 41 at −18° C.

For such a container, on average 6.0 kg snow is consumed per hour to compensate for heat inleak through the insulated walls. Thus, for a 24 hour journey, 144 kg of carbon dioxide snow is required to deliver frozen foodstuff at approximately the same temperature at which it starts the journey (i.e. at approximately −18° C.).

Accordingly the bag 10 is suitable, for example, for use in a standard international container such as the container 40, for the type of application described above.

During the journey, the carbon dioxide snow 14 sublimates to form gaseous carbon dioxide which escapes through the wall 22 of the bag 10.

Figure 3:
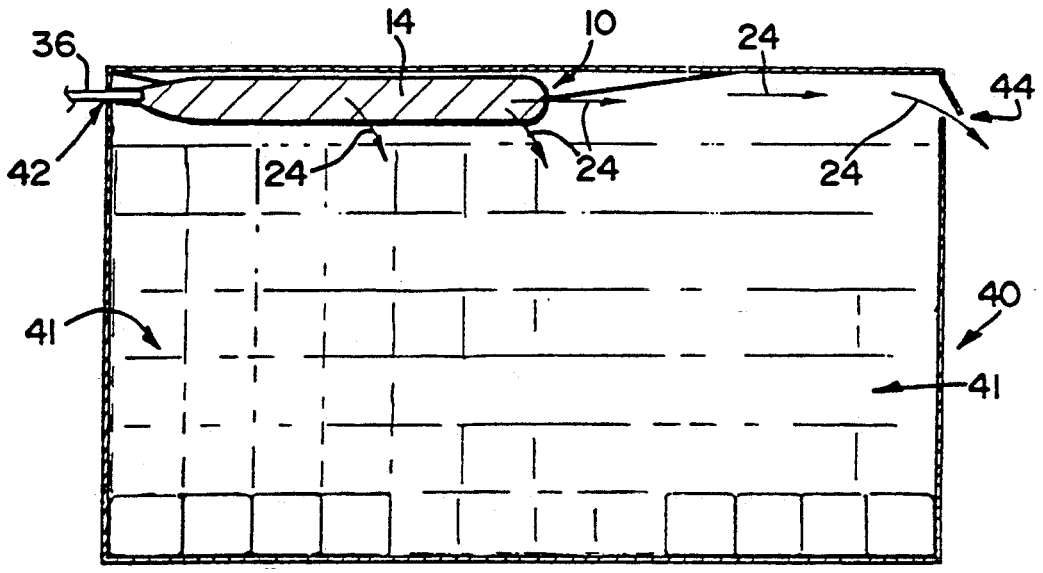
FIG. 3 is a schematic section through a container which is being provided with a refrigeration facility according to the method of the invention.

FIG. 3 shows a container 40 being provided with a refrigeration facility according to the method of the invention and in a similar manner to what is described in Example 1 above. The only difference is that in the present example, the bag 10 is installed in the container 40, adjacent the ceiling, before it is charged with carbon dioxide snow 14. After installation of the bag 10, carbon dioxide snow 14 is introduced into the bag 14 via the lance 18 which is inserted into the bag 10 via the inlet port 42 in the container wall. The gaseous carbon dioxide being formed during this snow shooting process, escapes through the wall 22 of the bag 10 and passes out of the container 40 via the gas vent 44 in the container wall. When the bag 10 has been charged with the desired mass (in this case 144 kg) of carbon dioxide snow 14, the lance 18 is removed and the inlet port 42 and gas vent 44 are closed.

Figure 5:
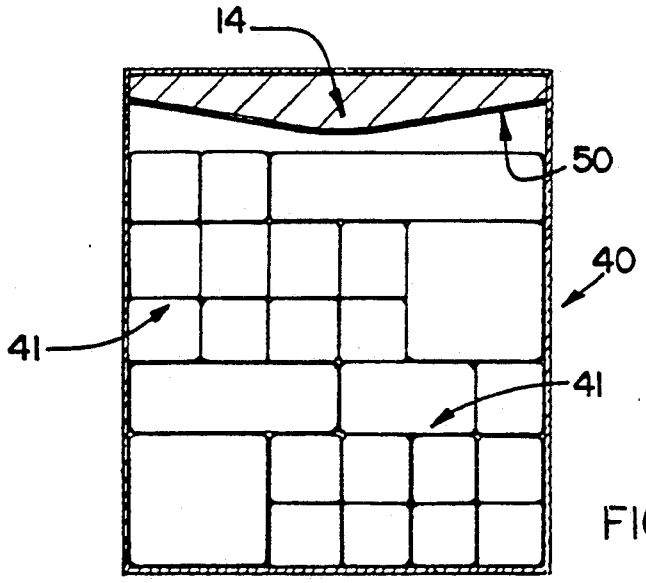
FIG. 5 is a schematic section through a container which has been provided, in an alternative manner with a refrigeration facility in the form of a second embodiment of a holder according to the invention.

FIG. 5 shows an alternative holder 50 according to the invention in the form of a sheet of metal mesh, or in the form of a sheet of polyethylene or polypropylene or nylon material similar to the material of which the bag 10 is made. The sheet 50 is suspended from the ceiling or upper walls of the container 40 to define a space immediately below the ceiling of the container 40, for accommodating carbon dioxide snow 14.

144 kg of carbon dioxide snow 14 is produced by the snow making device 30 and charged directly into the space between the carbon dioxide-permeable sheet 50 and the ceiling of the container 40 via the inlet port 42 (not shown in FIG. 5) in the container wall, and using the lance 18 (not shown in FIG. 5). After completion of snow shooting, the lance 18 is withdrawn and the inlet port 42 and gas vent 44 (not shown in FIG. 5) are closed.

Upon arrival at the final destination, the doors of the container 40 which have been refrigerated according to the method of the invention described in any one of examples 1 to 3 above, should be left open for a few minutes to allow any remaining carbon dioxide gas to escape so that safe offloading can be effected.

Figure 6:
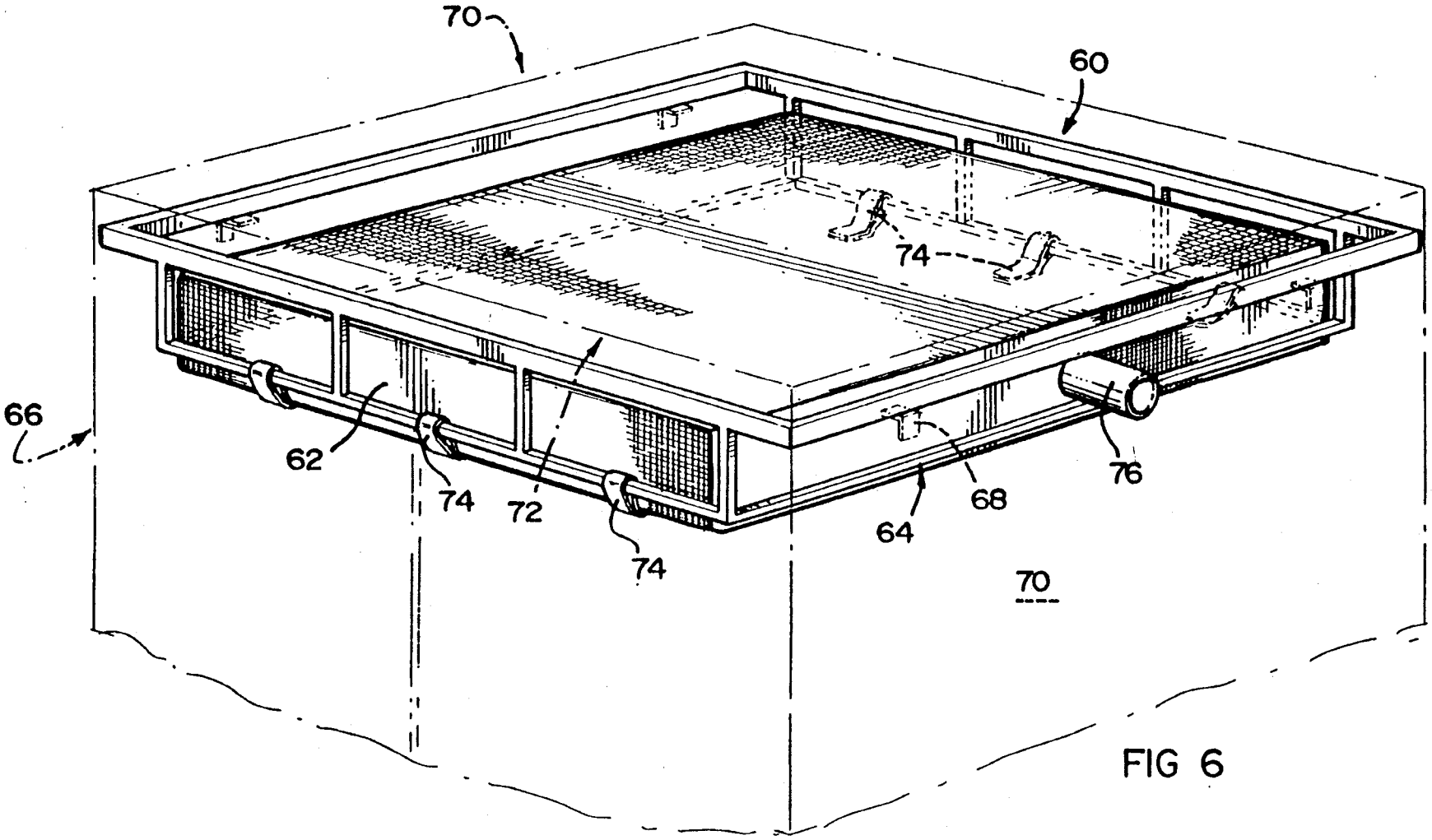
FIG. 6 is a three-dimensional view of a support structure/holder combination according to the invention, with a container in which it is mounted being shown in broken lines.
Figure 7:
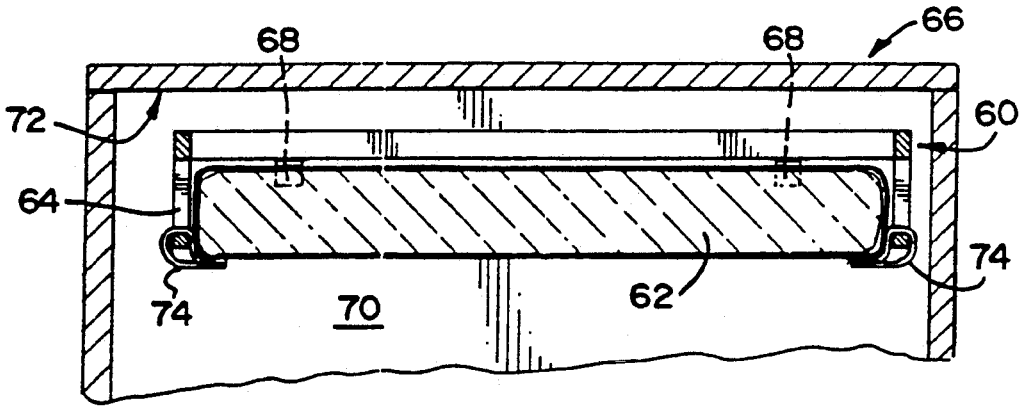
FIG. 7 is a partly sectioned side view of a container in which is mounted the combination of FIG. 6.
Figure 8:
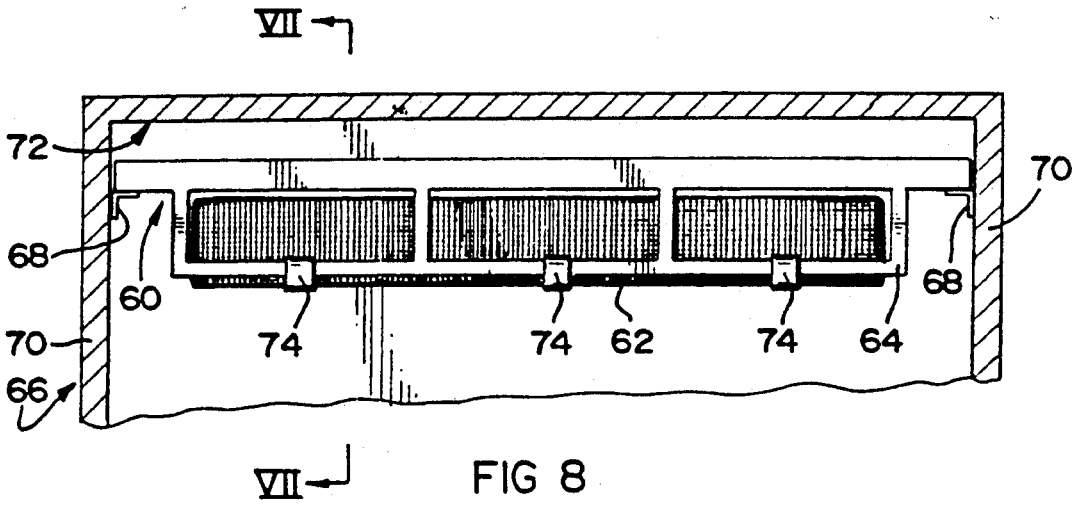
FIG. 8 is a section through 8—8 on FIG. 7.

In FIG. 6, reference numeral 60 generally indicates a combination support structure/holder according to the invention. The combination 60 comprises a bag 62 similar to the bag 10 and a framework 64 for supporting the bag 62. The framework 64 is mountable within a container for goods 66 by means of brackets 68 provided for that purpose on opposed walls 70 of the container 64 adjacent the container ceiling 72.

The size of the bag 62 is 2 m×1.75 m×0.03 m. It has attachment means in the form of VELCRO TM strips 74 whereby it is attached to the framework 64. In use, the bag 62 is charged with carbon dioxide snow via an inlet tube 76.

"VELCRO" is a trade mark of Velcro Industries B.V.

As mentioned previously, sufficient snow is provided in the container to maintain the temperature of the load during the entire journey. This snow therefore compensates for heat ingress from the relatively warm environment (at ambient atmospheric temperature) into the cooled interior of the insulated container. Heat in-flow occurs as a result of (1) heat in-flow through the container walls and (2) heat in-flow and carbon dioxide gas loss through openings in the container (e.g. open doors and faulty seals).

1. Heat in-flow through insulated container walls

The following formula is useful in estimating this heat flow.

$$\text{Heat in-flow } Q_1 = \frac{3600\,A\,U\,T}{d}\ \text{(kJ/h.)}$$

Where

A=External container surface area ($m^2$)

U=Coefficient of conductivity of insulating material (kw.m)/$M^{2\circ}$ C.

T=temperature difference between external ambient atmospheric temperature and load temperature (° C.)

d=Thickness of insulating material in container walls.

2. Heat in-flow and loss of cold $CO_2$ gas from container through 2.1 Opening of doors (e.g. for deliveries)

Estimation formula:

$$\textit{Net heat inflow } Q_2 = \delta_g V_c C_p T\, n\ (kJ/h.)$$

Where $\delta_g$=Density of $Co_2$ gas (kg/$m^3$)

$V_c$=Container internal free volume ($m^3$)

$C_p$=Specific heat of $CO_2$ gas (kJ)/kg° C.

T=Temperature difference (as above) (° C.)

n=Frequency of door openings (number/h.)

2.2 Leaks

Estimation formula:

$$\textit{Net heat in-flow } Q_3 = MC_p\,T\ (kJ/h.)$$

Where

M=$CO_2$ gas leakage rate (kg/h.)

$C_p$=Specific heat (as above) (kJ)/(kg° C.)

T=Temperature difference (as above)(° C.)

$$\text{Total heat in-flow into container } Q = Q_1 + Q_2 + Q_3 \text{ (kI/h)}$$

$$\text{Snow required } S = \frac{Q_1 + Q_2 + Q_3 \text{ (kg/hr)}}{R}$$

Where

R=$CO_2$ snow refrigeration capacity (kJ/kg)

$$\textit{Liquid } CO_2 \textit{ required } L = S \times f \textit{ (kg/h.)}$$

Where

S=snow required (as above) (kg/h.)

f=liquid to snow conversion factor and is 2 for permeable snow holder and is 2.7 for conventional snow injection The preferred holders 10, 50, and 62 are designed to hold sufficient snow in such a way that it will absorb heat (by way of sublimation) at a rate similar to the total net rate of heat in-flow into the container, thereby maintaining load temperature at any desired value in atypical range of −20° C. (for frozen goods) to +5° C. (for chilled goods).

The following three snow holder parameters are relevant:

Volume:

Estimation formula for desired volume ($V_H$):

$$\text{Holder volume } V_H = \frac{S \times t}{\delta_s} \text{ (m}^3\text{)}$$

Where

S=Snow required (as above) (kg/h.)

t=Desired maximum journey duration (h.)

$\delta_s$=Density of semi-compacted snow in holder (kg/m$^3$)

Dimensions: (or surface to volume ratio):

Dimensions of snow holder should be compatible with load and method of loading (refer examples).

Permeable surface to volume ratio of the snow holder is a factor that determines the rate of heat absorption of the snow holder when it is in use with carbon dioxide snow and which should substantially match the rate of heat in-flow into the container in order to maintain load temperature.

High heat in-flow rates will require relatively high permeable surface to volume ratio snow holders and vice versa (refer examples).

Material:

The following requirements should be met:

1. An ability to withstand low temperature of snow (−76° C.).
2. An appropriate heat buffer (if required) between snow on the one hand and the container atmosphere and goods on the other hands. The nature and thickness of the material is another factor that determines the rate of heat absorption of the snow holder.
3. Sufficient permeability such that:
   Carbon dioxide snow is contained within the holder and carbon dioxide gas passes through the holder during injection of the snow into the holder, and
   $CO_2$ gas can escape from the holder at an appropriate rate to help maintain load temperature in use.

Examples A and B below, are examples of how the approximate amount of carbon dioxide snow required for use in a particular application of the method of the invention, can be calculated.

This enables the desired dimensions of a holder according to the invention for the particular application to be determined.

EXAMPLE A

Railway Mini Container

Surface area (excluding floor)

$A_1$=23.7 m$^2$

U=2.8×10$^{-5}$ kWm/m$^2$° C. (polyurethane foam)

d=0.085 m $$\begin{aligned} T &= \text{ambient minus frozen load temperature} \\ &= 25 - (-18)° \text{ C.} \\ &= 43° \text{ C.} \end{aligned}$$

Heat in-flow through walls and roof $$\begin{aligned} Q_{1A} &= \frac{3600 \times 23.7 \times 2.8 \times 10^{-5} \times 43}{0.085} \\ &= 1209 \text{ kJ/h.} \end{aligned}$$

Surface area of floor $A_2$=3.6 m$^2$

U=2.8×10 kWm/m$^2$° C.

d=0.01

T=43° C.

Heat in-flow through floor $$\begin{aligned} Q_{1B} &= \frac{3600 \times 3.6 \times 2.8 \times 10^{-5} \times 43}{0.01} \\ &= 1209 \text{ kJ/h.} \end{aligned}$$

$Q_2$=0 because the container doors remained closed during the trip.

However tests revealed a relatively high value for $CO_2$ gas loss because of inadequate door seals, of 11 kg/h. (=M)

$C_p$=0.63 kJ/kg° C.

T=43° C.

$$\begin{aligned} \text{Heat in-flow } Q_3 &= 11 \times 0.63 \times 43 \\ &= 298 \text{ kJ/h.} \end{aligned}$$

Total net heat in-flow $$\begin{aligned} Q &= Q_{1A} + Q_{1B} + Q_2 + Q_3 \\ &= 1209 + 1560 + 0 + 298 \\ &= 3067 \text{ kJ/h.} \end{aligned}$$

Snow refrigeration capacity R=640 kJ/h.

$$\begin{aligned} \text{Therefore: Snow required } S &= \frac{3067}{640} \\ &= 4.8 \text{ kg/h.} \end{aligned}$$

$$\begin{aligned} \text{Liquid } CO_2 \text{ required } L &= 4.8 \times 2 \\ &= 9.6 \text{ kg/h.} \end{aligned}$$

$$\begin{aligned} \text{Required trip duration } t &= 30 \text{ hours} \\ \delta_s &= 400 \text{ kg/m}^3 \end{aligned}$$

-continued $$\text{Snow bag volume } V = \frac{4.8 \times 30}{400} = 0.35 \text{ m}^3$$

Desired bag dimensions were determined as follows:
The bag should occupy minimum cargo space.
It should have a high permeable surface to volume ratio of 16 to 4 in order to compensate for high rates of heat in-flow through the floor and because of leaking doors.

A permeable bag similar to the bag 60 but having dimensions 2 m×1.2 m×0.15 m covered most of the container roof area and was found to satisfy the above requirements.

Bag material

Tests showed that woven polypropylene material, single end warp, twill weave, 30×16 constitution, meet the requirements of
ability to withstand low temperatures
carbon dioxide gas permeability
low heat absorption capacity

EXAMPLE B

Door-to-Door Delivery Truck

Truck container surface area=23.5 m$^2$
U=2.8×10$^{-5}$km/m$^{2\circ}$ C. (polyurethane)
d=0.05 m $$T = \text{ambient-chilled load temperature} = 25 - 5 = 20^\circ \text{ C.}$$

Heat in-flow through walls $$Q_1 = \frac{3600 \times 23.5 \times 2.8 \times 10^{-5} \times 20}{0.05} = 948 \text{ kJ/h.}$$

An average of four deliveries per hour (i.e. n=4) were to be made to deliver chilled goods.

$$\text{Container free volume } U_c = 7.5 \text{ m}^3 \text{ total} - 0.4 \text{ m}^3 \text{ load} = 7.1 \text{ m}$$

$\delta_g$=1.84 kg/m$^3$
$C_p$=0.63 kJ/kg° C.
T=20° C.

Heat in-flow through door openings $$Q_2 = 1.84 \times 7.1 \times 0.63 \times 20 \times 4 = 658 \text{ kJ/h.}$$

$Q_3$=0 because doors seal well $$\text{Total heat in-flow} = Q_1 + Q_2 + Q_3 = 948 + 658 + 0 = 1606 \text{ kJ/h.}$$

Snow refrigeration capacity R=640 kJ/kg

Therefore:

-continued $$\text{Snow required } S = \frac{1606}{640} = 2.5 \text{ kg/h.}$$

$$\text{Liquid } CO_2 \text{ required } L = 2.5 \times 2 = 5 \text{ kg/h.}$$

$$\text{Max trip duration} = 6 \text{ hours}$$

$$\delta_s = 400 \text{ kg/m}^3$$

$$\text{Snow holder } V_H = \frac{2.5 \times 6}{400} = 0.0375 \text{ m}^3$$

Figure 9:
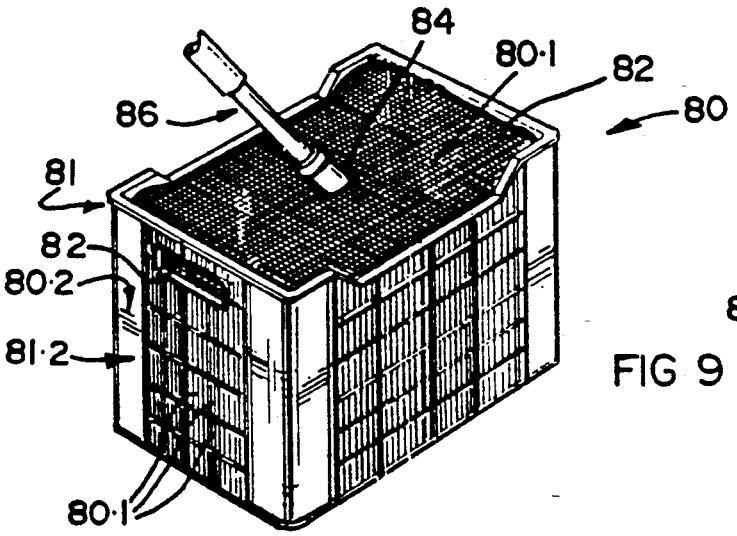
FIG. 9 is a three-dimensional view of a third embodiment of a holder according to the invention.

In FIG. 9, reference numeral 80 generally indicates a third embodiment of a holder according to the invention. The holder 80 comprises a standard plastics crate 81 with wall apertures 81.1, 0.04 m$^3$ in volume, which is lined with 30×16 weave polypropylene material 82. A sheet of the polypropylene material 82 covers the top opening of the crate and provides a flexible wall 80.1 of the holder 80, the wall 80.1 being permeable to carbon dioxide snow.

Instead of the polypropylene material, open (14#) steel mesh can be used to provide the lining and the flexible wall 80.1.

Figure 15:
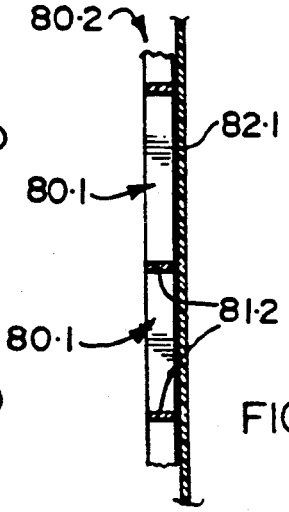
FIG. 15 is an enlarged cross-sectional view through a side wall of the holder of FIG. 9.

On the side walls 80.2 of the holder 80 is shown in cross section in FIG. 15. Reference numerals 81.2 and 82.1 indicate the wall of the plastics crate 81 and a region of the sheet 82, respectively.

In use the holder 80 is charged through an opening 84 in the polypropylene sheet 82, with carbon dioxide snow injected therein via a conventional snow shooting lance 86.

A particular advantage of the holder 80 is the relative ease with which it can be manually loaded into and removed from a container.

An approximate number of holders 80 were charged with carbon dioxide snow and loaded into a container as described in Example B above, with 0.04 m$^3$ plastics crates containing chilled goods. The number of holders 80 containing carbon dioxide snow was determined according to the expected duration of the journey and the expected number of deliveries (i.e. door openings) to be undertaken. (In this case an average of four deliveries per hour were to be made.) It was expected that the relatively low surface area to volume ratio of each of the holders 80 and the relatively short periods of time between consecutive door openings, would necessitate using a fan within the container to speed up the carbon dioxide sublimation reaction to heat in-leak. It was found that the resulting refrigerated container was effective throughout the journey in maintaining the crates of goods at a suitably low chilled temperature while avoiding undesired freezing of the goods.

Figure 10:
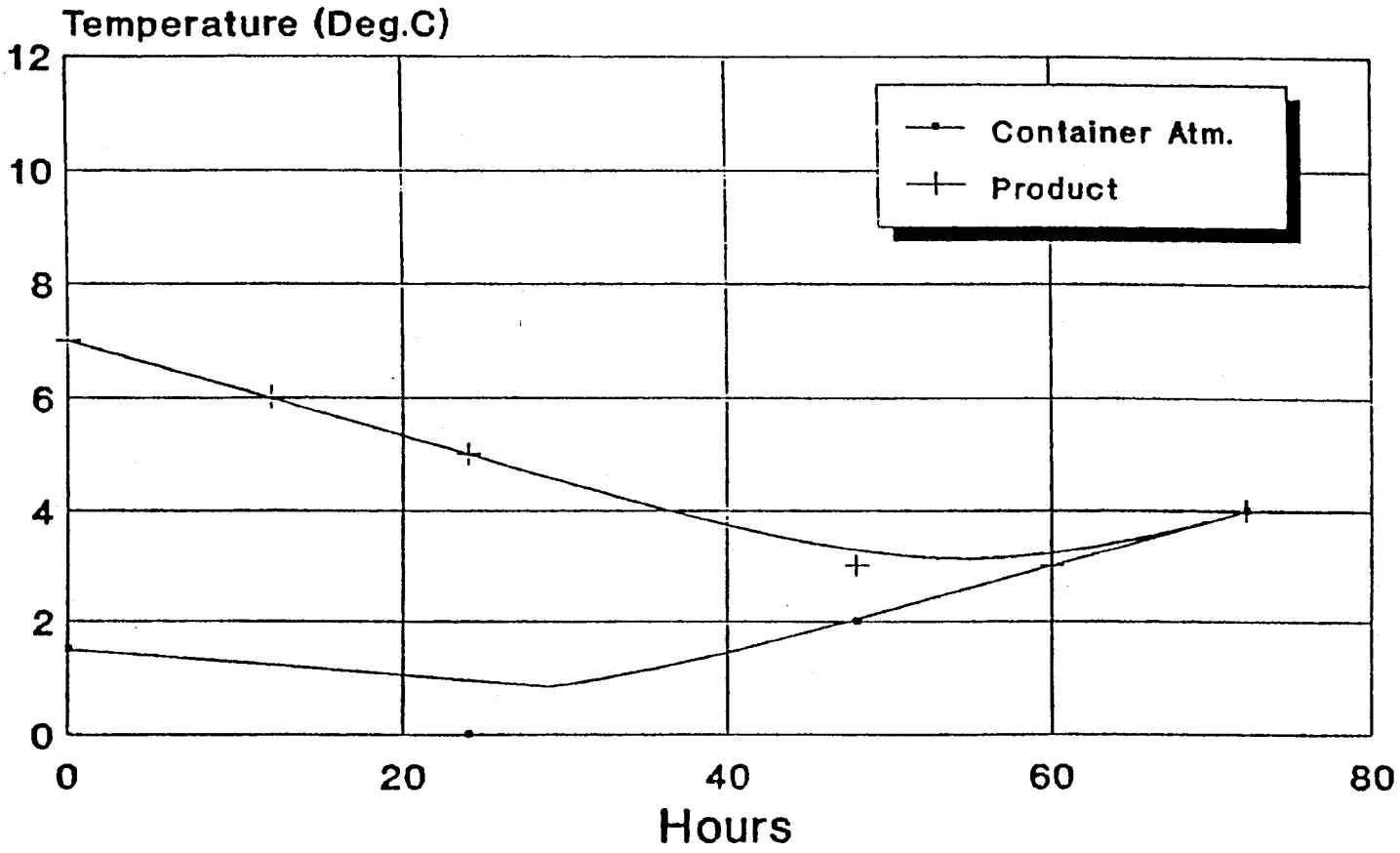
FIG. 10 is a graphical illustration of respective temperature profiles of the atmosphere within a container with a refrigeration facility according to the invention in use with carbon dioxide snow, and chilled goods contained therein.
Figure 12:
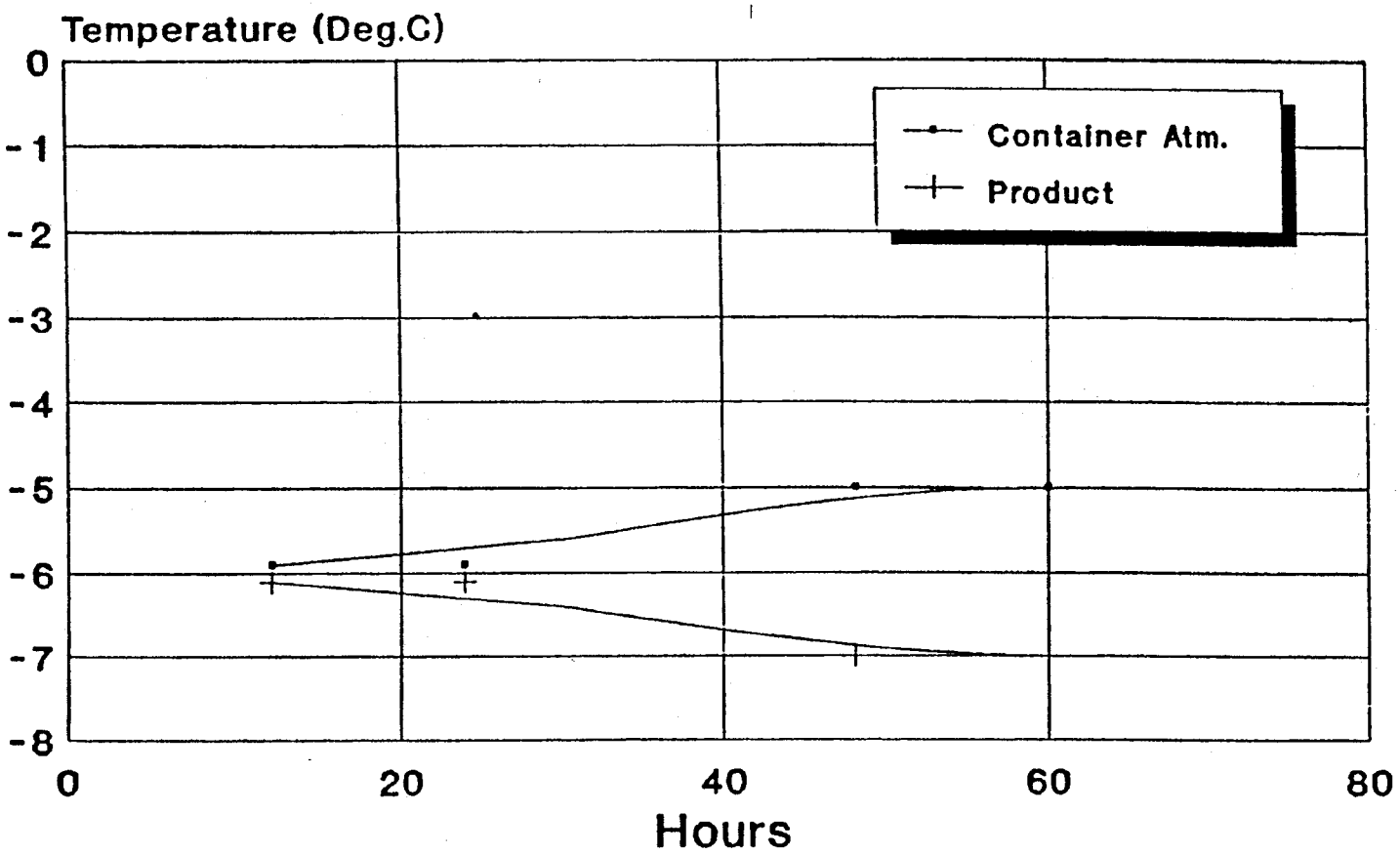
FIG. 12 is a graphical illustration of respective temperature profiles of the atmosphere within a container with a refrigeration facility according to the invention in use with carbon dioxide snow, and frozen goods contained therein.

The efficacy of a refrigerated container comprising a holder according to the invention which has been charged with an appropriate mass of carbon dioxide snow, is illustrated graphically in FIGS. 10 and 12.

Figure 11:
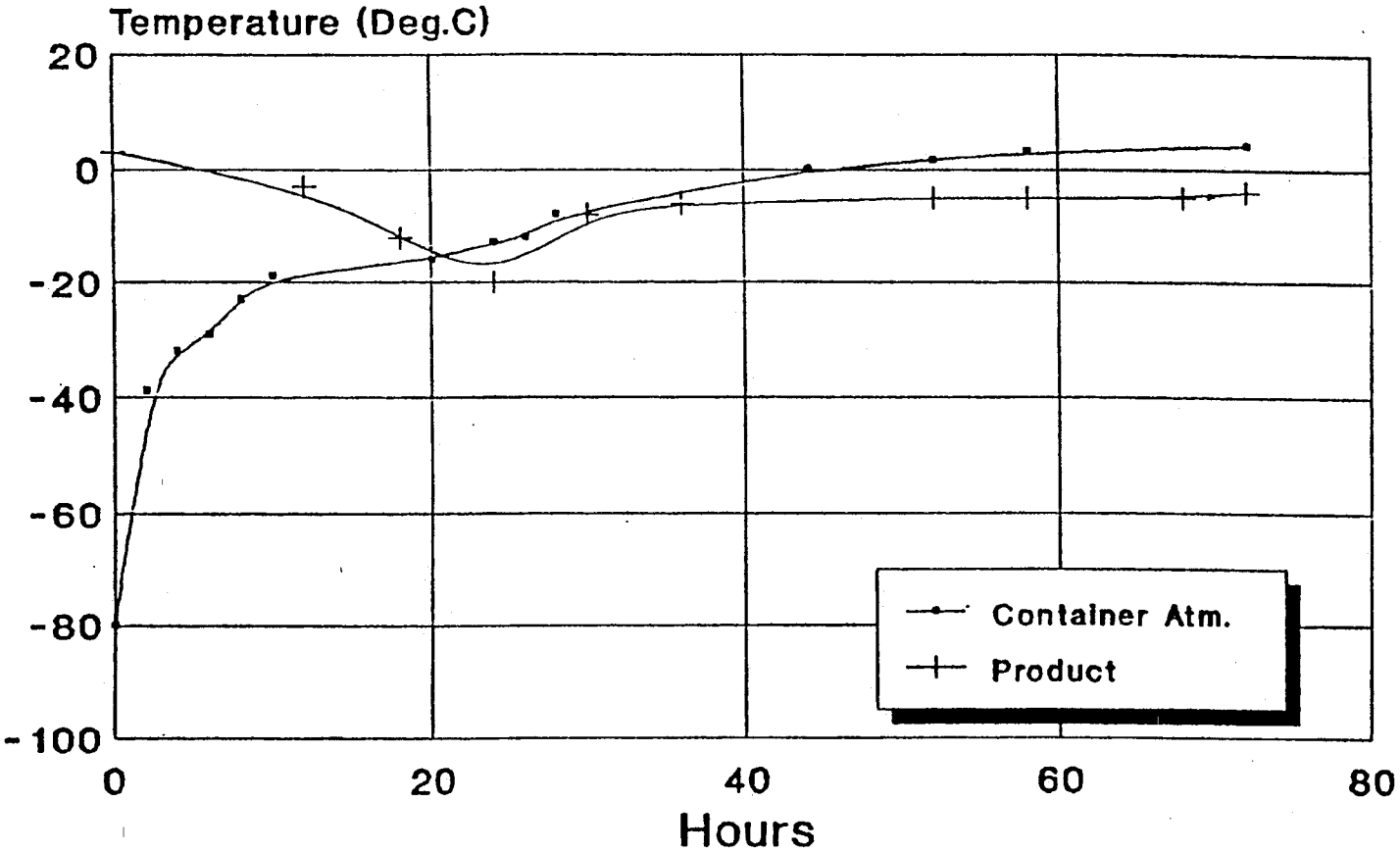
FIG. 11 is a graphical illustration for comparison purposes, of respective temperature profiles of conventional container and chilled goods contained therein, and into which container carbon dioxide snow has been injected directly.
Figure 13:
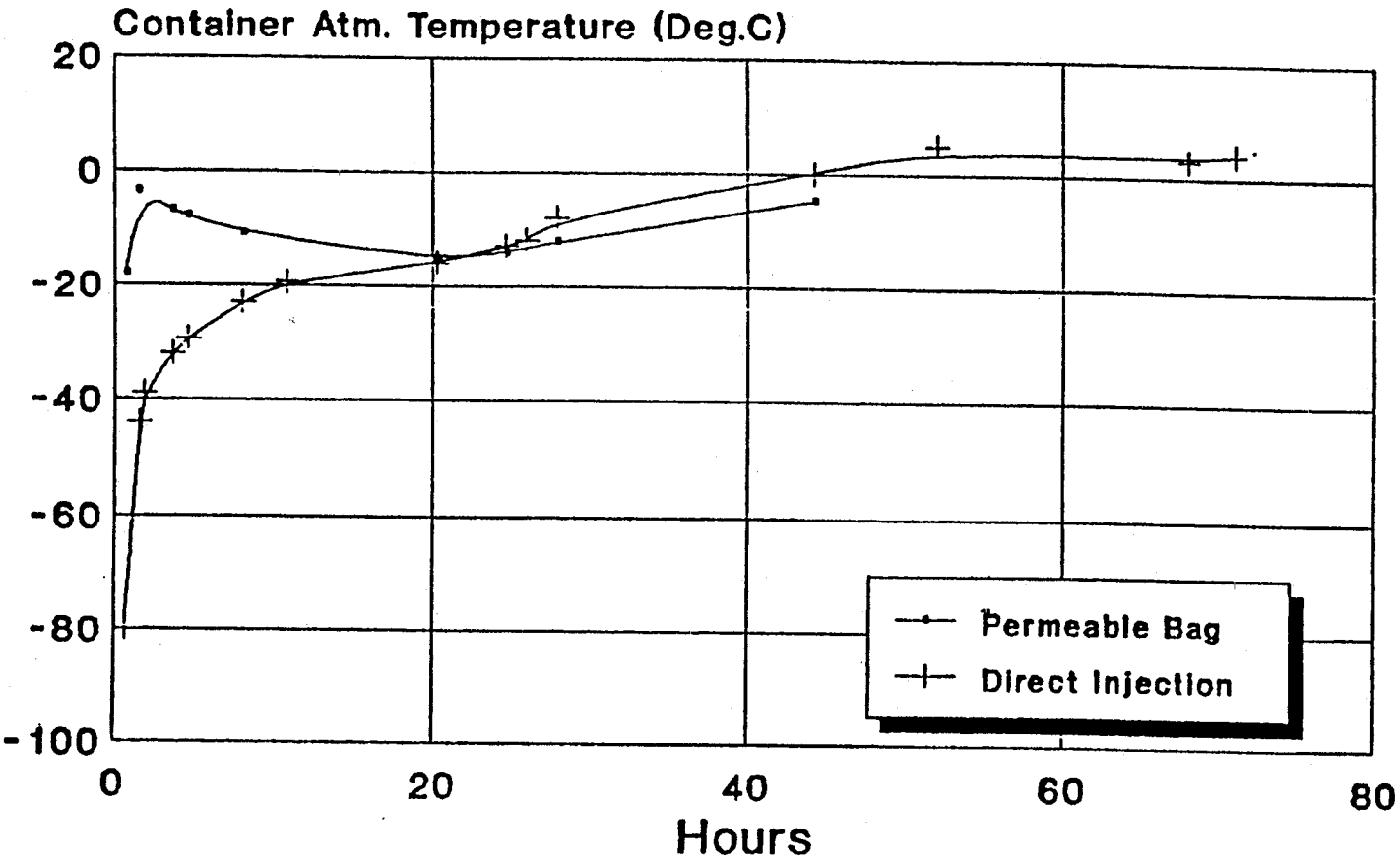
FIG. 13 is a graphical comparison between a temperature profile of the atmosphere within a container with a refrigeration facility according to the invention in use with carbon dioxide snow, and a temperature profile of the atmosphere within a conventional container into which a similar mass of carbon dioxide snow has been injected directly.

Furthermore, a comparison of FIGS. 10 and 12 (the invention) with FIG. 11 (prior art), and consideration of FIG. 13 which illustrates refrigeration conditions of both the invention and the prior art, show that a container refrigerated according to the method of the invention does not undergo the thermal shock to which a container refrigerated by direct snow injection (prior art) is subjected. Furthermore, chilled products in the refrigerated container of the invention (FIG. 10) is not subjected to freezing as are the chilled products in the container which is refrigerated according to prior art techniques (FIG. 11). It will be appreciated that products comprising fresh fruit, vegetables, dairy products, etc. are damaged, or at least the quality thereof is adversely affected, by freezing.

FIG. 10 graphically illustrates the efficacy of the above exemplified means and method of the invention in maintaining chilled goods at suitable low temperatures above freezing point, for extended periods of time. As can be seen from FIG. 11, conventional means and methods of charging carbon dioxide snow directly into conventional containers loaded with chilled (i.e. non-frozen) goods at temperatures in the range up to about 7° C. cause freezing of the goods. This adversely affects the quality of goods such as fresh fruit, vegetables and dairy products.

FIG. 12 graphically illustrates the efficacy of the above exemplified means and method of the invention in maintaining frozen goods at temperatures below 0° C. The apparently anomalous decrease in the temperature of the frozen goods as the temperature of the container atmosphere increases can be explained by the experimental conditions.

In fact the respective temperatures of the goods and container atmosphere respectively were taken at remote locations from each other within the container and, expectedly, the temperature of the goods was not uniform throughout the container; nor was the temperature of the container atmosphere. The respective temperatures of goods and atmosphere positioned adjacent each other doubtless would have been substantially the same.

FIG. 13 graphically compares the respective temperature profiles of atmosphere within a container refrigerated according to the invention, and a conventional container which is refrigerated by direct injection of carbon dioxide snow. The sudden reduction in temperature of the container atmosphere from about 0° C. to −80° C. in the conventional case causes thermal shock to the container walls. In contrast no such thermal shock is experienced by container walls when the means and method of the present invention are used.

Figure 14:
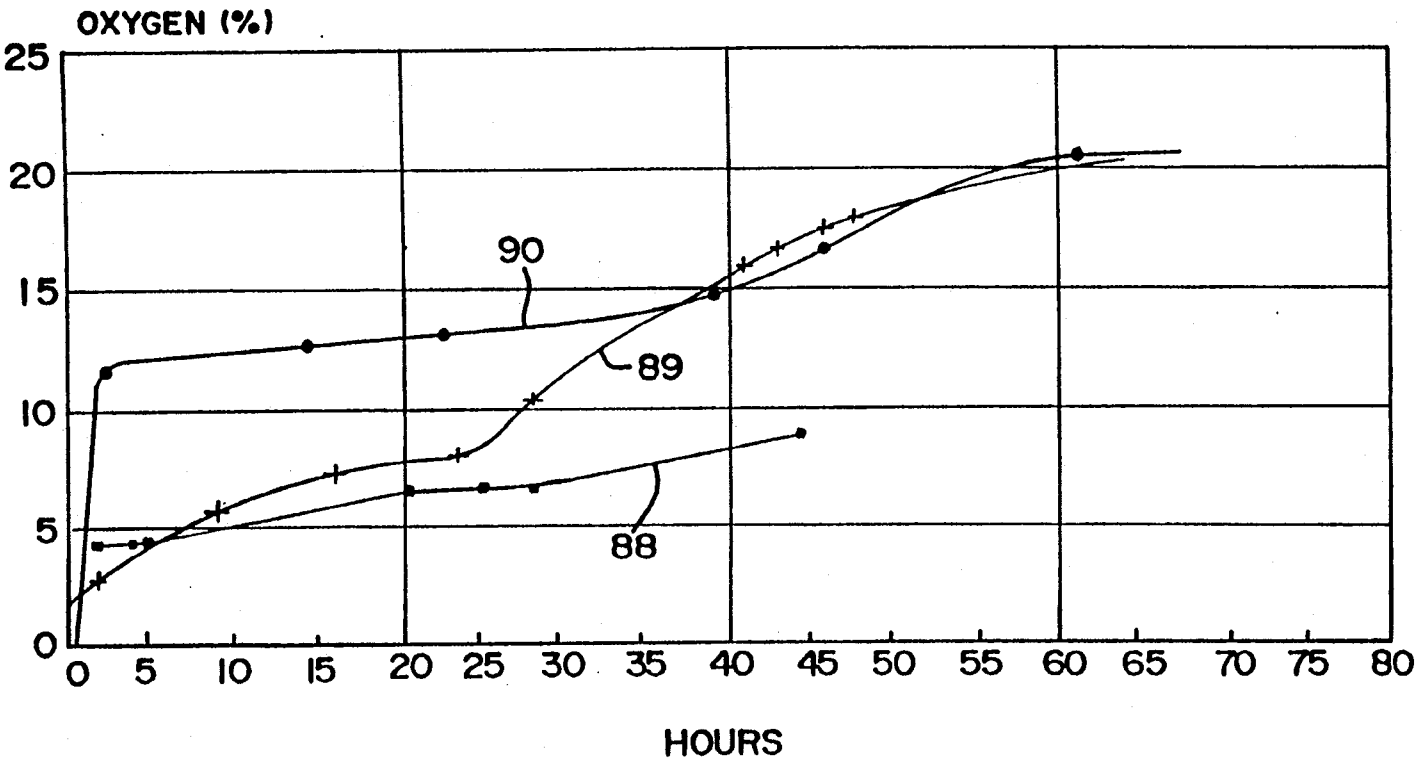
FIG. 14 is a graphical comparison of respective oxygen profiles of the atmospheres within three different containers each having a refrigeration facility according to the invention, in use with carbon dioxide snow.

Graphs 88, 89, and 90 in FIG. 14 indicate the respective oxygen profiles of the atmospheres within the following containers which have been provided with refrigeration facilities according to the invention:

Reference numeral 88 relates to a 6 m container with new door seals.

Reference numeral 89 relates to a 6 m container with suspect door seals.

Reference numeral 90 relates to a 1.5 m container with inadequate door seals.

As can readily be seen, the proportion of oxygen in the container atmosphere relatively quickly increases to about 4% and is maintained in the range 5 to 15% for an extended period of time, i.e. in excess of 40 hours.

The advantages of the invention, at least as exemplified, include the greater efficiency in the conversion of liquid carbon dioxide to carbon dioxide snow obtained according to the method of the invention and the resulting saving in costs. This is believed to be the result of a reduction in sublimation losses of snow particles during the actual snow shooting operation. Because of the abovementioned semi-compacted state of the snow particles on the inner side of the gas permeable wall of the holder according to the invention, the rate of snow sublimation is reduced. It will be appreciated that the usefulness of the semi-compacted snow as a coolant, particularly as a means for maintaining and not necessarily reducing the temperature of goods, is thereby enhanced.

Furthermore, snow shooting of carbon dioxide into a holder of the type envisaged herein for use in the method of the invention, enables the snow shooting lance to be inserted into the holder through an inlet port approximating to that of the cross-sectional dimensions of the lance. Thus loss of carbon dioxide which occurs during conventional direct snow shooting into containers for goods (e.g. because of leaking door seals, etc.) is obviated or, at least minimized.

An advantage of the carbon dioxide atmosphere which results from using carbon dioxide snow as a coolant in the method of the invention, is its biocidal or at least its bacteriostatic properties for applications in which products such as foodstuffs are being refrigerated. Furthermore it will be appreciated that the holder according to the invention serves to control the rate of sublimation of the carbon dioxide snow which allows the proportion of oxygen in the atmosphere within the container to be maintained between approximately 5% and 15%. This proportion of oxygen inhibits the deterioration of respiring fresh produce which would otherwise occur in a more concentrated carbon dioxide atmosphere.

Further advantages include a reduction in the thermal shock on transport container walls and goods because of containment of snow within the holder according to the invention. Furthermore, a more uniform time vs temperature profile within the transport container and load is obtained because of the relatively low rate of snow sublimation and separation of the snow from the goods. Furthermore, the means for containing the snow and keeping it separate from the goods, i.e. the holder according to the invention, is light weight, space efficient, low in cost, and readily locatable in and removable from conventional containers. Thus the method and means according to the invention are versatile and adaptable to suit any of a large number of possible applications.

We claim:

1. A method of providing a counter having interior surfaces, defining an interior of the container, with a refrigeration facility for maintaining goods located within the interior of the container in a frozen or chilled condition, said method including: supporting in gaseous communication with the interior of the container, a discrete holder for holding carbon dioxide snow, said holder being supported within the interior of the container so as to be spaced from the interior surfaces thereof; and said holder having a total wall area and a continuous wall region of the holder, constituting at least about 15% of the total wall area of the holder, fabricated of a flexible material that is at least substantially impermeable to the carbon dioxide snow and permeable to gaseous carbon dioxide.

2. The method as claimed in claim 1, wherein the holder has an insignificant thermal absorption capacity.

3. The method as claimed in claim 1, wherein the holder is a plastic, a cotton, or a wool fabric.

4. The method as claimed in claim 1, wherein the holder is of wire mesh.

5. The method as claimed in claim 1 wherein the holder is in the form of a bag.

6. The method as claimed claim 1 wherein the holder is supported within the container so that it is readily removable from the container.

7. The method as claimed in claim 1 wherein the holder is supported within the container by attaching it to the support structure and the support structure and holder are located within the container.

8. The method as claimed in claim 1, including charging carbon dioxide snow into the holder before supporting the holder in the container.

9. The method as claimed in claim 1, wherein carbon dioxide snow is charged into the holder after supporting the holder in the container.

10. The method as claimed in claim 1, wherein the container has a ceiling and the holder is supported within the container adjacent the ceiling of the container.

11. A combination including:

a container having an interior for holding goods; and a bag for holding carbon dioxide snow in gaseous communication with the interior of the container, said bag supported within the interior of the container so as to be spaced from interior surfaces thereof and fabricated of a flexible, porous material that is at least substantially impermeable to carbon dioxide snow and permeable to gaseous carbon dioxide and having a pore size of about 0.5 mm.

12. A combination suitable for use in providing a container for goods with a refrigeration capability, said combination comprising:

a bag fabricated of a flexible, porous material that is at least substantially impermeable to the carbon dioxide snow and permeable to gaseous carbon dioxide and having a pore size of about 0.5 mm; and a support structure for supporting the bag and attachable to a wall or ceiling of the container such that the bag is supported within the container, spaced from interior surfaces of the container.

* * * * *